United States Patent [19]

Hemphill

[11] Patent Number: 4,713,897

[45] Date of Patent: Dec. 22, 1987

[54] REVERSIBLE DIGGING TEETH AND HOLDER THEREFOR

[76] Inventor: Charles W. Hemphill, 1106 Green Valley La., Duncanville, Tex. 75116

[21] Appl. No.: 725,434

[22] Filed: Apr. 22, 1985

[51] Int. Cl.[4] ..... E02F 5/06

[52] U.S. Cl. ..... 37/83; 37/142 R; 37/191 A; 299/91; 403/379

[58] Field of Search ..... 37/141 R, 141 T, 142 R, 37/142 A, 83, 86, 191 R, 191 A; 403/379, 378; 299/82, 83, 91, 93

[56] References Cited

U.S. PATENT DOCUMENTS

| | | | |
|---|---|---|---|
| 1,960,879 | 5/1934 | Russell et al. | 37/142 R X |
| 2,168,794 | 8/1939 | Fulke | 37/142 R X |
| 2,217,347 | 10/1940 | Morrow | 37/142 R X |
| 3,330,651 | 7/1967 | Younkin | 37/142 R X |
| 3,453,756 | 7/1969 | Schroeder | 37/142 R |
| 4,037,337 | 7/1977 | Hemphill | 37/142 R X |
| 4,187,626 | 2/1980 | Greer et al. | 37/141 R |

*Primary Examiner*—Edgar S. Burr
*Assistant Examiner*—Moshe I. Cohen
*Attorney, Agent, or Firm*—Marcus L. Bates

[57] ABSTRACT

A combination digging tooth and holder therefor for use on excavating machines. Each holder has provisions by which it can be attached to an endless chain of a trencher or to a bucket lip. The forward part of the holder has an outwardly opening pocket formed therein of a particular configuration which receives part of the digging tooth in close tolerance relationship therewithin such that a forward marginal part of the tooth extends forwardly from the holder for engaging and digging in the earth. Each opposed marginal end of each of the teeth has identical cutting edges formed thereon so that a tooth can be reversed as well as being substituted one for the other. The teeth cooperate with the holder pocket in an unusual manner.

3 Claims, 18 Drawing Figures

REVERSIBLE DIGGING TEETH AND HOLDER THEREFOR

BACKGROUND OF THE INVENTION

The modern trencher and backhoe machines excavate material from the earth in an efficient and rapid manner. These machines are available in various different sizes and sometime cost more than a quarter million dollars. Hence, the hourly cost of operating the large backhoe bucket or the large trencher is astronomical; but on the other hand, the cost is very little compared with the results, and especially the results when contrasted with other methods of excavating earth.

The design of the digging tooth used on a backhoe bucket or a trencher directly governs the efficiency of operation of the entire machine. The worn condition of the digging teeth can influence the digging efficiency more than 50 percent, depending upon the type of formation being excavated. In some instances, as the digging teeth progressively wear, the efficiency can drop from 300 feet of ditch per day, down to less than 100 feet of ditch per day, for example. Accordingly, it is desirable that an excavating machine be provided with sharp digging teeth of optimum design respective to the formation being excavated.

Digging teeth which may be maintained in good cutting condition, rapidly replaced, and low in cost is the subject of the present invention.

SUMMARY OF THE INVENTION

This invention comprehends a combination tooth-receiving holder and digging tooth therefor. The tooth-receiving holder of the present invention comprises a main body having a forward end and a rear end aligned respective to a digging tooth so that a tooth mounted within a tooth-receiving pocket of the holder is disposed in properly aligned relationship respective to the direction of travel of the excavating machine. The tooth has a main body which is a polygon in lateral cross-section. The polygon preferably is a quadrilateral, and more specifically is square in cross-sectional area. The opposed ends of the teeth are provided with identical cutting edges by the formation of spaced oblique faces arranged parallel to one another and defining the extremities of the tooth.

The oblique face preferably is a plane in the form of a diamond, with each corner of the diamond being one corner of the quadrilateral or square.

The configuration of the pocket is made complementary respective to the configuration of either marginal end of a tooth so that the cutting face, cutting edge, and sidewalls of the tooth are received in close tolerance relationship with respect to complementary arranged interior wall surfaces of the pocket.

The foregoing description of a pocket and tooth enables the digging teeth to be reversed within a pocket of a shank, there by providing each of the teeth with dual cutting edges, and enabling any one of the teeth to be interchanged for another, as well as being reversed as may be required as the cutting edge is worn.

This remarkable configuration of a digging tooth further enables the cutting edges thereof to be resurfaced or dressed in the field so that the excavating machine is essentially provided with an inexhaustible supply of sharp digging teeth.

The teeth of this invention are fabricated from an elongated piece of metal stock of satisfactory alloy, which has been normalized and sawed at spaced intervals, with each of the saw lines being arranged parallel to one another and defining the face of the teeth. The teeth are subsequently heat treated to achieve optimum hardness. Hard surface material is applied to the opposed cutting faces of the tooth.

The hard surface material applied to the opposed parallel faces of the tooth increases the thickness of the tooth in the area of the faces, and impart the tooth with a step which must be accommodated by the pocket. The pocket is therefore provided with a recess within which the hard surface material is received.

Accordingly, a primary object of the present invention is the provision of a shank and tooth combination for an excavating machine which enables any one tooth to be exchanged for any other tooth, as well as enabling each of the teeth to be reversed within a pocket in order to present a new cutting edge forwardly of the shank.

Another object of the invention is to provide a tooth and holder combination, wherein the tooth has cutting edges formed on opposed marginal ends of the cutting teeth, and with the holder having a pocket made complementary respective to either marginal end of the tooth.

A further object of this invention is to disclose and provide a tooth and pocket combination in which the digging tooth is provided with a cutting edge at each extremity thereof so that either cutting edge can be utilized by reversing the tooth within the pocket.

A still further object of this invention is to provide a tooth and holder combination which enables digging loads encountered by the cutting edge of the tooth to be transferred into the holder and then into the excavating machine in an improved and unusual manner.

Another and still further object is to provide a tooth and holder combination which enables the digging tooth to be reversed within a pocket of the holder and thereby present a new cutting edge, and which furthermore enables the cutting edge of the tooth to be field dressed in an easy and efficient manner.

Another object of this invention is to provide a reversible digging tooth having opposed digging ends, with there being a built-up layer of hard surface material applied to a marginal area of opposed parallel faces of the tooth, and with there being a tooth receiving holder having a pocket which includes a special recess therein for accommodating the layer of hard surface material.

Another object of this invention is to provide a combination holder and digging tooth wherein the holder is of a configuration which places the cutting edge of the tooth against the sidewall of an excavation in a manner wherein the holder does not bear against the excavation sidewall.

These and various other objects and advantages of the invention will become readily apparent to those skilled in the art upon reading the following detailed description and claims and by referring to the accompanying drawings.

The above objects are attained in accordance with the present invention by the provision of apparatus fabricated in a manner substantially as described in the above abstract and summary.

DETAILED DESCRIPTION OF THE PREFERRED EMBODIMENT

Figure 1:
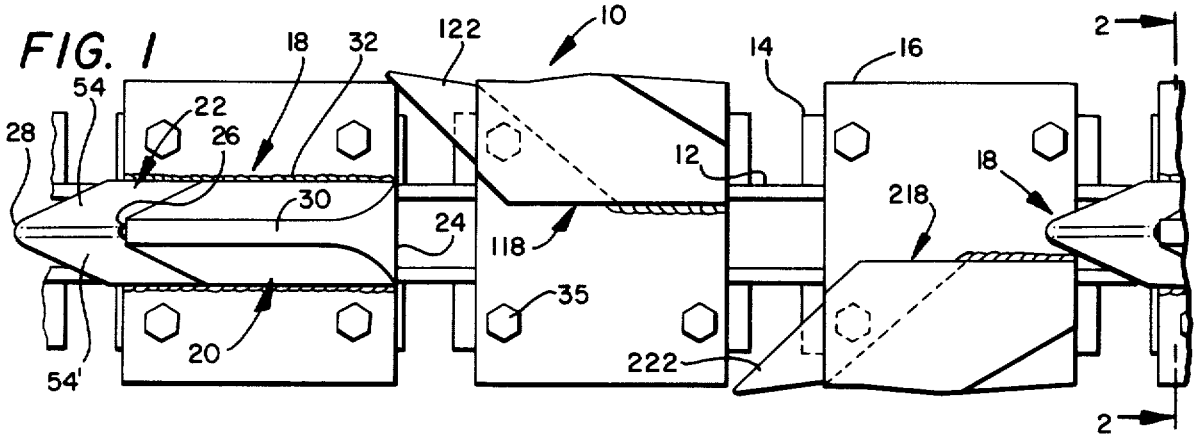
FIG. 1 is a broken, top view of part of an excavating machine showing a combination shank and tooth made in accordance with the present invention.

In FIG. 1 of the drawings, there is disclosed part of an excavating machine 10, preferably an endless chain type trencher machine such as a Vermeer 600 (Tella, Iowa). The trencher machine 10 includes an endless chain 12 having series arranged lugs 14 attached thereto in spaced relationship respective to one another. Plate member 16 is bolted onto adjacent ones of the lugs 14. A tooth and holder assembly 18, made in accordance with this invention, is mounted to each of the plate members 16.

The combination tooth and holder assembly 18 comprises a tooth-receiving holder 20 which removably receives a digging tooth 22 therein, as will be more fully described later on in this disclosure.

The holder 20 includes a rear end 24 and a forward end 26. The tooth 22 includes a forward digging end 28. The holder 20 preferably is welded onto the plate member 16 and aligned respective to adjacent tooth and holder combinations to provide various different patterns, depending upon the desired width of the ditch, the geological structure of the earth, and the physical characteristics of the excavating machine.

Figure 2:
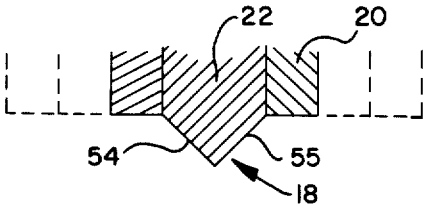
FIG. 2 is a cross-sectional view taken along line 2—2 of FIG. 1.

In FIG. 2 of the drawings, there is disclosed a cross-sectional view of the combination tooth and holder 18. The digging tooth 22 is seen to be in the form of a polygon in lateral cross-section. The polygon preferably is a quadralateral and is square in cross-sectional area.

Figure 3:
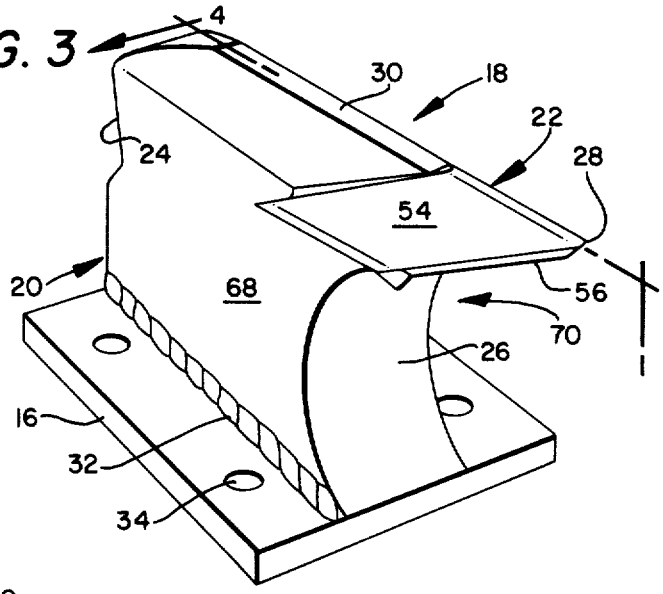
FIG. 3 is a perspective view of part of the apparatus disclosed in FIG. 1.

As seen in FIG. 3, together with other figures of the drawings, the holder 20 has a lowermost surface 30, and an upper surface which is welded at 32 onto the plate member 16.

Figure 4:
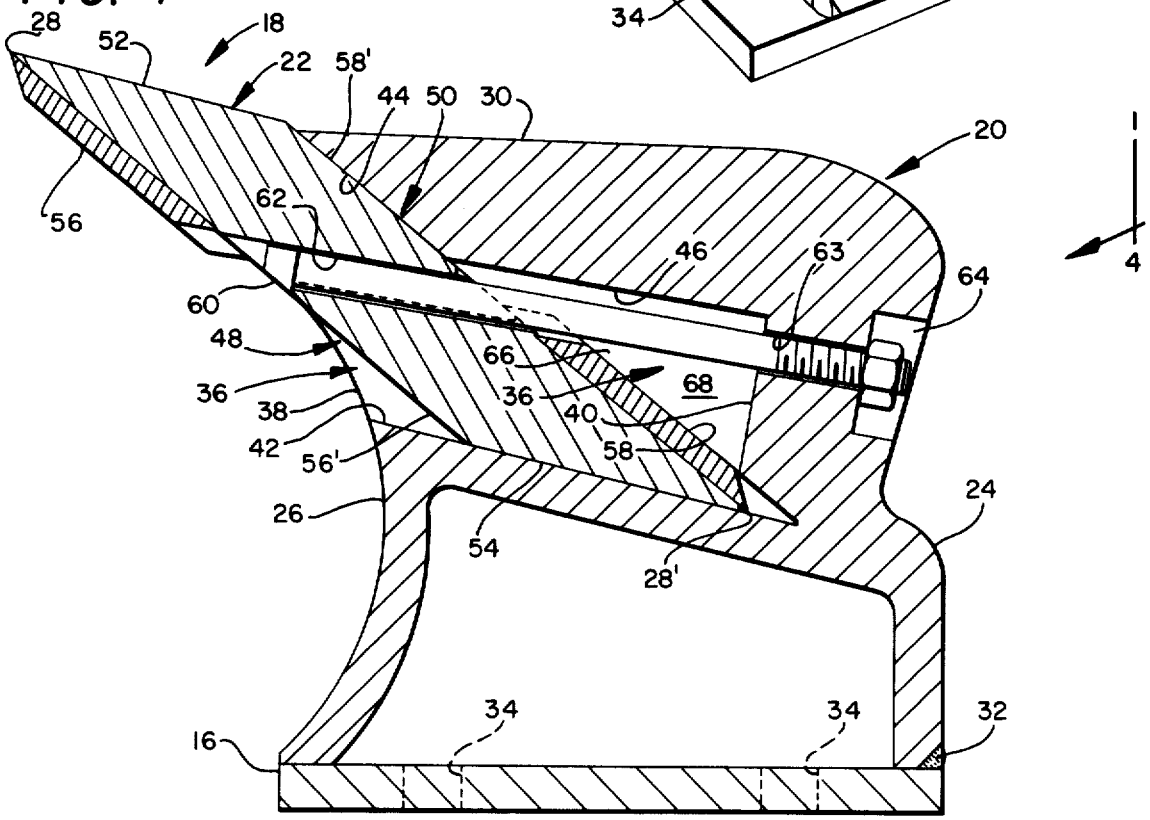
FIG. 4 is a cross-sectional view taken along line 4—4 of FIG. 3.

FIG. 4 presents a cross-sectional representation of the combination tooth and holder assembly 18. The assembly has been removed from the endless chain 12 of FIG. 1 by removing bolts 35 from bolt holes 34. As seen in FIG. 4, the holder 20 includes a pocket 36 which outwardly opens at 38. The pocket is formed by interior end wall 40, top wall 42, inclined wall 44, and bottom wall 46.

The digging tooth 22 of the present invention includes opposed parallel walls 48 and 50 which terminate at opposed parallel walls 52 and 54. Wall 48 is provided with approximately ⅛ inch build up of hard surfacing 56 while wall 50 is similarly provided with hard surfacing 58. The hard surfacing 56 and 58 increase the thickness of the marginal ends of the tooth and form a step which must be accommodated by the holder pocket 36.

A through bolt 60 is received through axially aligned passageways 62 and 63, respectively, formed through the tooth and holder, respectively. Numeral 64 illustrates a cavity for receiving the illustrated nut which is threadedly affixed to the bolt 60 and secures the tooth within the pocket.

Figure 8:
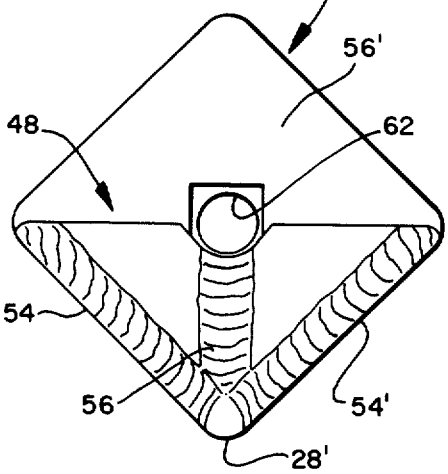
FIG. 8 is a front view of the apparatus disclosed in FIG. 7.
Figure 7:
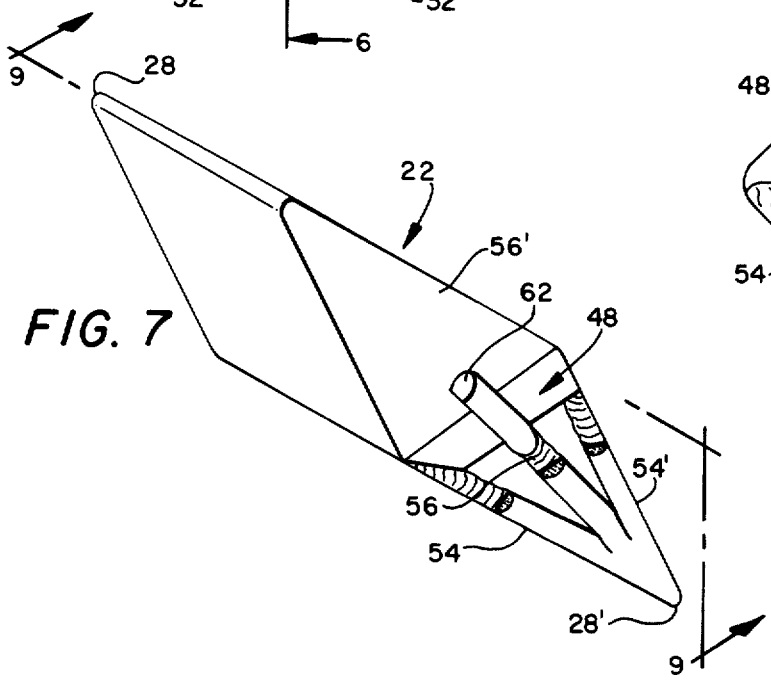
FIG. 7 is a perspective view of part of the combination disclosed in FIGS. 3 and 4.
Figures 9, 10, 11, 12:
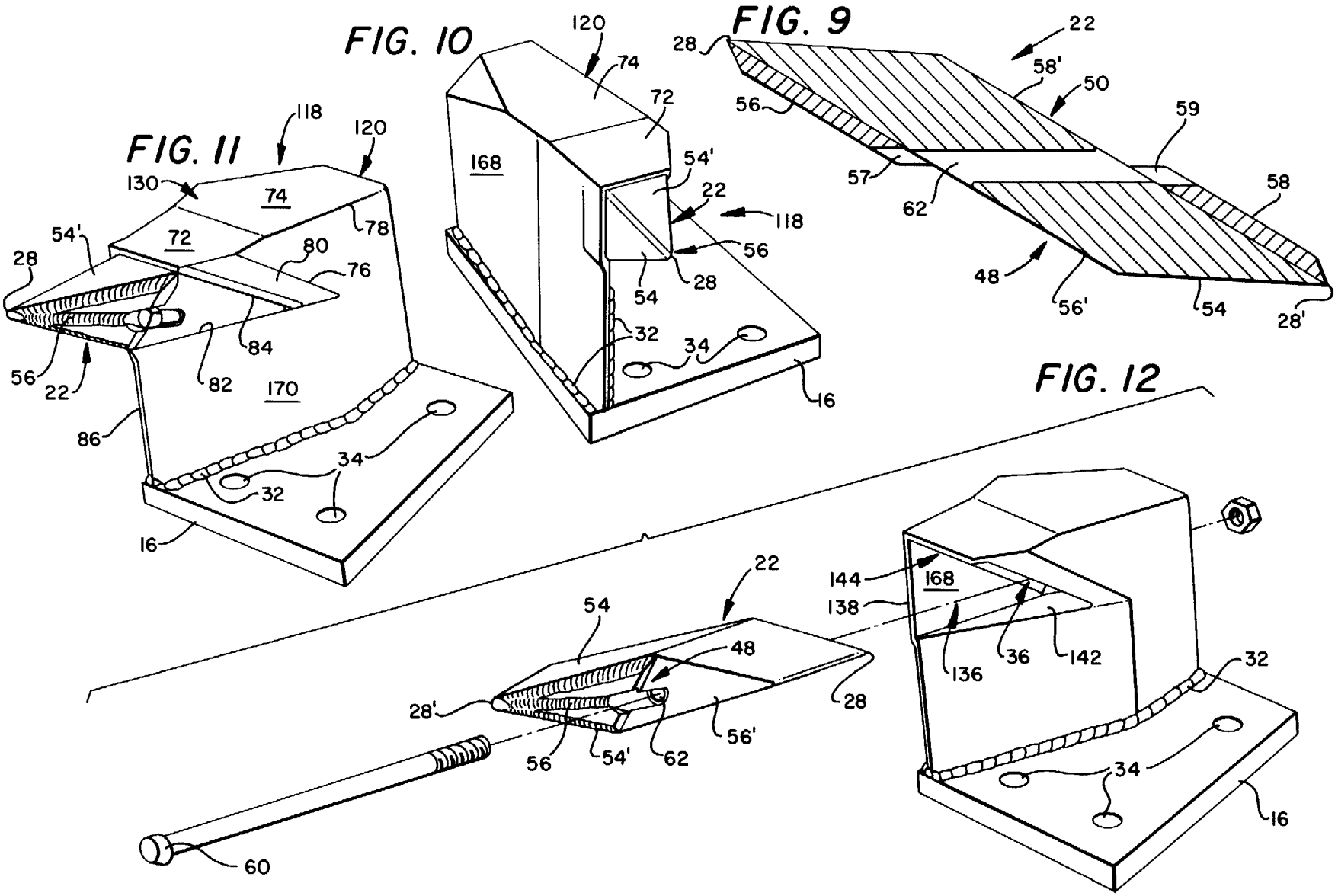
FIG. 9 is a longitudinal, cross-sectional view taken along line 9—9 of FIG. 7.
FIG. 10 is a perspective view of a second embodiment of the invention.
FIG. 11 discloses the opposed side of the embodiment of the invention seen illustrated in FIG. 10.
FIG. 12 is a disassembled view of the apparatus disclosed in FIGS. 10 and 11.
Figure 13:
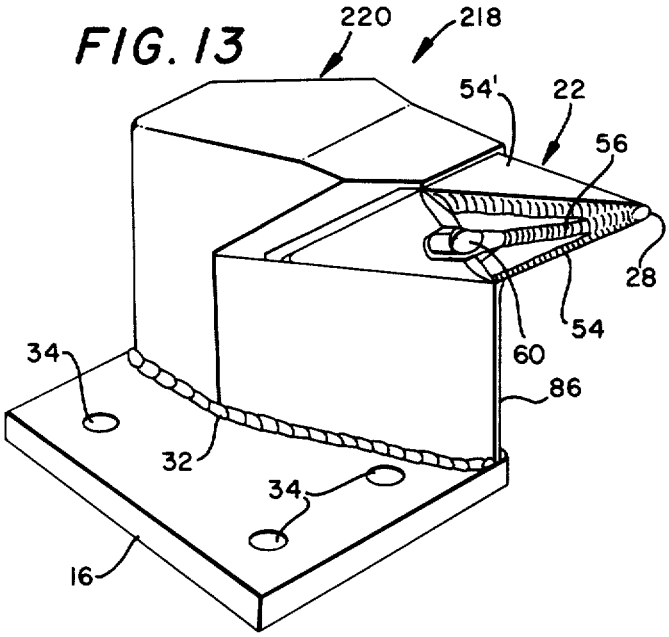
FIG. 13 is a perspective view of still another embodiment of the invention.
Figure 14:
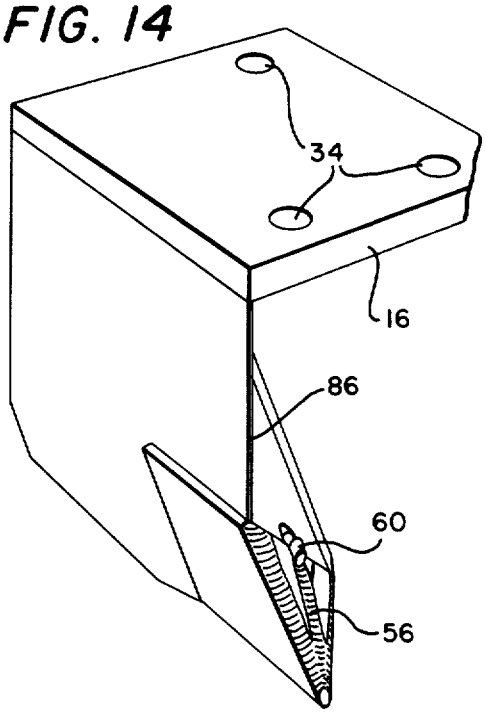
FIG. 14 is a perspective bottom view of the apparatus seen disclosed in FIG. 13.

As particularly seen in FIGS. 7–9, together with other figures of the drawings, the tooth 22 is made into a configuration which provides identical cutting ends 28 and 28'. Either of the marginal opposed ends of the tooth 22 can be selectively received within the pocket 36 of the holder 20. The digging tooth 22 has a layer of hard surfacing material at 56, 58 which extends from 28, 28' towards a medial portion near bolthole 62 of the tooth, and terminates at edge 57, 59. Cutting face 50 of tooth 22 is abuttingly received against outer or inclined wall 44 of the holder 20, while, wall 54 of the tooth 22 is received against top wall 42 of the holder 20. The through bolt 60 is received through a medial part of the tooth and urges the confronting walls 44, 58' and 42, 54 to bear against one another.

Figure 6:
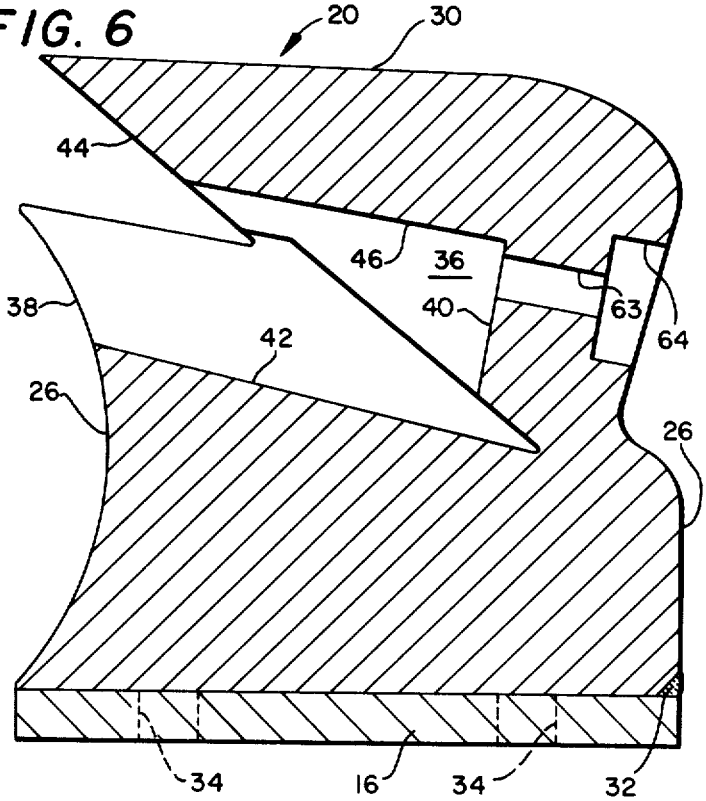
FIG. 6 is a longitudinal cross-sectional view taken along line 6—6 of FIG. 5.
Figure 5:
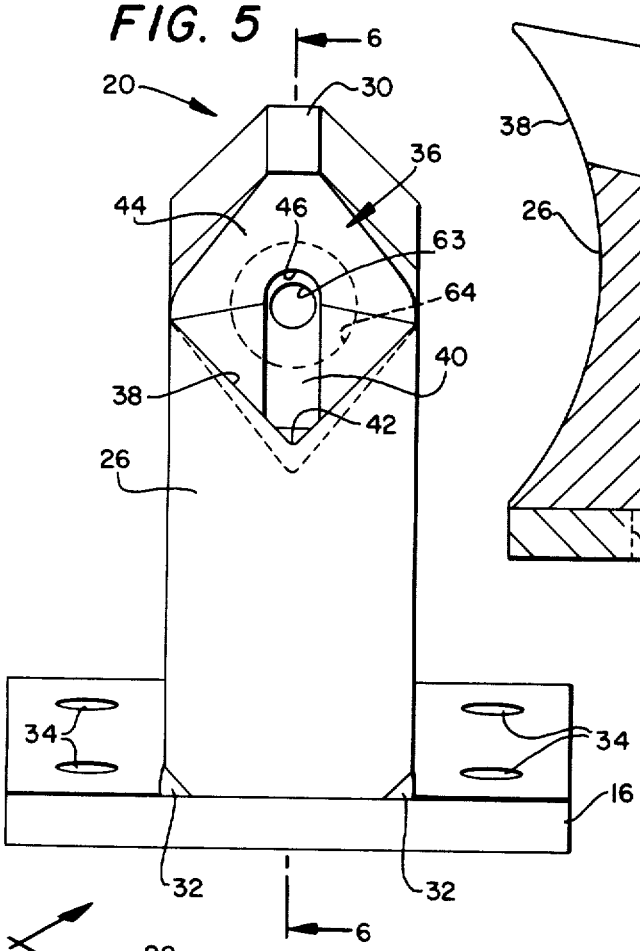
FIG. 5 is a front view of part of the apparatus disclosed in FIG. 4.

As best seen in FIGS. 4 and 6 of the drawings, the pocket 36 includes a chamber 66 within which space is provided for receiving the hard surfacing 56, 58 applied to the faces of the digging tooth 22. The hard surfacing 56, 58 of FIG. 4 can be applied by welding, as for example a welding rod having particles of Tungsten carbide incorporated therein. This techique also can be used to apply beads of welding 54, 54' to the cutting face of FIGS. 7, 8, and 11.

In the embodiments of the invention set forth in FIGS. 10–12, part of the sidewall 170 adjacent the tooth 22 has been removed from the holder 120, thereby leaving edges 82 and 84. Sidewall 168 is located on the other side of the tooth. This novel configuration of the holder and tooth assembly aligns the cutting edges of the digging tooth respective to the sidewall of the ditch in a manner which excavates earth in a superior manner. The holder illustrated in FIGS. 10–12 is preferred for the tooth and holder arrangement seen at 118 in FIG. 1. The same tooth 22 can be used in the various different embodiments of the present invention, and can be secured to the holder in the manner set forth in FIGS. 4, 11, and 12, for example.

In FIGS. 10–12, the bottom 130 of the holder is comprised of bottom walls 72 and 74 placed at a slight angle respective to one another. Sidewall 170 is welded to plate member 16 as in the before example, and joins the bottom walls 72, 74 at edge 78. The sidewall 170 is inclined towards the pocket as indicated by numeral 80. Numerals 82 and 84 illustrate the edge portions of the window formed into the pocket by the absence of a portion of the sidewall 170. The leading edge 86 of the holder is in the form of a chisel for reducing the drag or frontal area of the digging apparatus.

FIGS. 13–16 illustrate still another embodiment of the digging tooth and holder combination 218. The holder 220 receives the tooth 22 therein in the before described manner. A sidewall of the shank has been removed, thereby leaving part of one side of the tooth exposed so that the tooth, rather than the holder, bears against the sidewall of the ditch during the excavation process and greatly facilitates excavating material from the earth in a new and unobvious manner.

Figure 15:
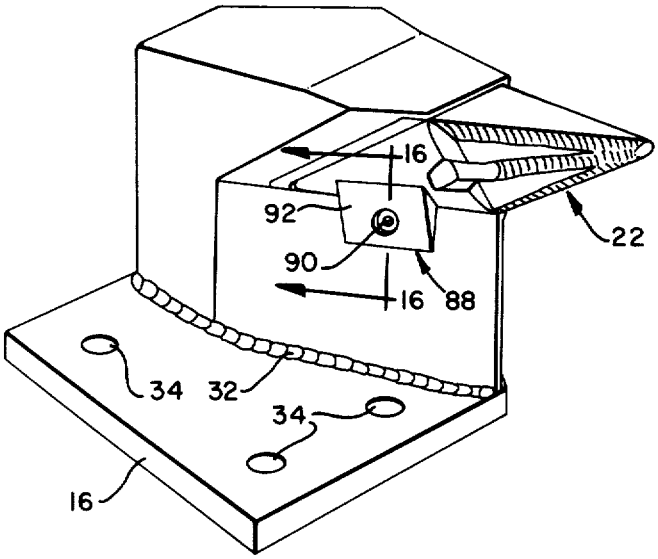
FIG. 15 is a perspective view of another embodiment of this invention.
Figure 16:
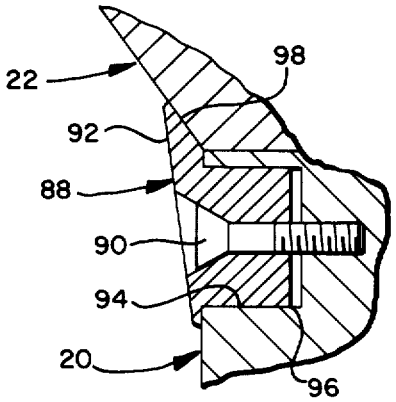
FIG. 16 is an enlarged, fragmentary, cross-sectional view showing a detail of the apparatus of FIG. 15.

As seen in FIGS. 15 and 16, a keeper 88 is used to maintain the tooth and holder in attached relationship. A fastener 90 holds the keeper 88 into the illustrated position of FIGS. 15 and 16. The keeper includes a male member 96 which is received within a female cavity 94. The cavity and male member are made complementary respective to one another. The keeper 88 includes a wedge-like sidewall 98 which bears against one face of the cutting tooth 22.

The present invention provides a holder and tooth combination which can advantageously be used on trenching machines and buckets of various different design. There are three embodiments of the invention presented herein. The first embodiment is used for digging the central part of the ditch, and the other two embodiments are used for digging the opposed sides of the ditch. All of the teeth are identical and therefore any one tooth can be substituted for any other tooth. Moreover, any tooth can be removed from any pocket and reinstalled with the previous digging end being inserted into the pocket, thereby reversing the digging end of the tooth. This presents a new cutting edge and thereby provides each of the teeth with dual cutting surfaces which may be selectively employed whenever needed by reversing any one tooth within its socket.

The interchangeability of the teeth provide new and unexpected results. Primarily, there are digging teeth on any excavating apparatus subject to more rapid wear as compared to the other teeth. Accordingly, the teeth can be interchanged now and then, thereby replacing those teeth which are subject to the greatest wear, so that the wear rate of all of the teeth are maintained uniform during the excavation project.

Moreover, while excavating earth, the teeth may become unduly worn and can be reversed within the pocket as explained above.

The opposed cutting faces 56 and 58 of the tooth 22 are aligned respective to one another and to the holder such that each face 56 and 58 slopes towards the central axis of the mount plate 16 or lowermost surface 30 of the holder 20, and slopes inwardly towards the longitudinal central axis of the chain 12. The teeth at 122 are located opposite to the teeth at 222, so that the face of the teeth located on either side of tooth 22 slopes upwardly towards the top of the ditch and inwardly towards the central tooth 22. This arrangement of the cutting faces of the several different assemblies 18 causes excavated material to be more readily removed and to flow away from the excavation in a superior manner.

All of the teeth at 22, 122, and 222 are identical; and therefore, any one tooth can be substituted for any other tooth. Moreover, any tooth can be removed from a pocket and reinstalled with the previous digging end being inserted into the pocket of any of the holders. This action presents a new cutting edge, thereby providing each of the teeth with dual cutting surfaces which may be selectively employed whenever needed by reversing any one tooth within its pocket.

Figure 17:
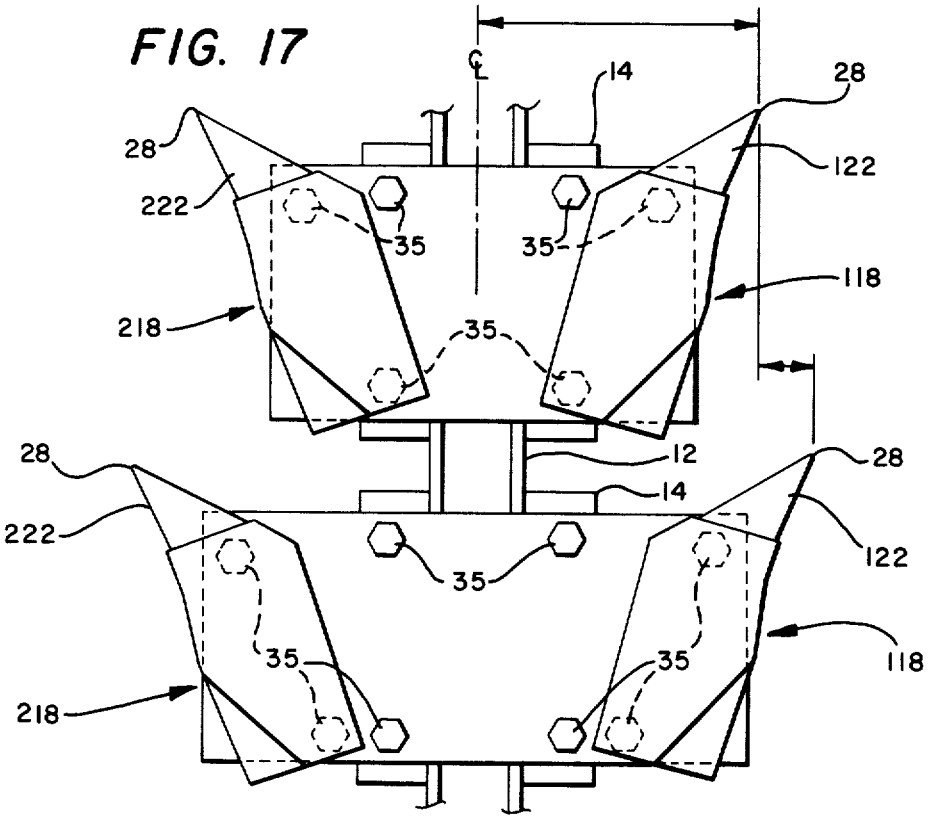
FIG. 17 is a fragmentary, top plan view of part of the apparatus seen in FIG. 1; and, FIG. 18 is a fragmentary, cross-sectional view of the earth showing an excavation carried out with the present invention.
Figure 18:
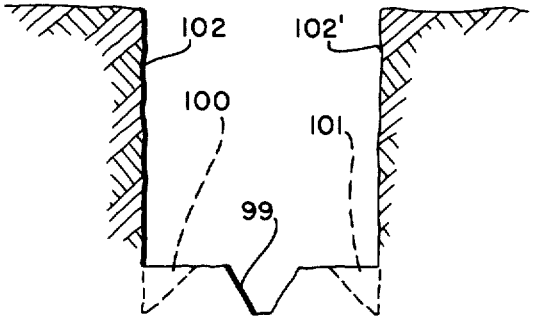

Looking now to FIGS. 1, 17, and 18, it will be noted that the central tooth 22 of FIG. 1 digs a central groove 99 of FIG. 18 which has two sidewalls 102, 102' and a bottom, while the opposed teeth 122 and 222 dig only a sidewall and bottom, as noted at 100, and 101.

The teeth of the present invention are low in cost; and therefore, an ample supply of teeth can be maintained available for use. This enables one set of teeth to be dressed while another set of teeth is being used by the excavating machine or trencher. As the teeth become dull, they are easily and quickly reversed within their pockets, and when both cutting edges have become dull, the teeth may be field dressed, thereby presenting a new cutting edge on the old teeth by the simple employment of a common bench grinder. New hard surfacing is easily applied to the cutting faces of the teeth, when the old surface becomes worn.

As seen illustrated in the various figures of the drawings, the main body of the tooth is polygonic in cross-section. The polygon preferably is a quadrilateral which has been truncated to form two oblique faces spaced apart and placed in parallel relationship respective to one another, with each of the faces being defined by a plurality of cutting edges. More specifically, the quadrilateral is a truncated, elongated, solid length of steel or steel alloy having the oblique face arranged in a plane which lies 36° respective to the bottom wall of the tooth, and also arranged at an angle of 36° respective to a sidewall thereof, so that the face slants upwardly back towards the holder and inwardly towards the longitudinal centerline of the endless chain or bucket.

The tooth and holder assembly of this invention provides an improvement over the prior art by the provision of a pocket of unusual configuration which cooperates with a new digging tooth which heretofore has been unknown to those skilled in the art. The tooth of the present invention has hard surfacing material applied in a layer, or as beads of welding, to provide a step or built-up area at the location on the tooth which receives the greatest wear. The pocket is provided with an interior chamber within which the built-up layer of hard surfacing material is accommodated.

The tooth has an area 56', 58' adjacent to the built-up hard surfacing material 56, 58 which abuttingly engages an area of the confronting surface 44 of the holder and thereby accepts the loads imposed on the assembly during the digging operation. The area provided by surface 52, 54 of the tooth similarly abuttingly engages the confronting surface 42 of the pocket, so that the tooth resists the above digging loads and is always maintained properly secured within the pocket.

I claim:

1. In an excavating apparatus having a plurality of tooth receiving holders mounted thereto, a digging tooth removably received within a pocket formed in each holder for engaging and excavating material, the improvement comprising:

each of said teeth has a unitary main body having opposed parallel faces (48, 50) which terminate at opposed parallel and walls (52, 54);

opposed marginal ends of each of said teeth terminate in similar cutting edges (56, 58) which extend from and are parallel to said faces (48, 50); said opposed parallel faces (48, 50) are in the form of a diamond, said tooth is a parallelogram in longitudinal cross-section;

each ofthe teeth receiving holders has means forming a tooth receiving pocket therein, said pocket is conformed to receive either of the opposed marginal ends of one of said teeth in close tolerance relationship therewithin; whereby the tooth can be arranged with either of the cutting edges directed away from the holder;

said pocket has an entrance defined by a forward end of the holder which terminates in a shoulder (44), said shoulder lies within a plane which is parallel to the opposed faces of the tooth; said pocket includes an inner wall (42) which is aligned parallel respective to the opposed ends of the tooth and abuttingly engages the end of the tooth which is enclosed within said pocket;

a fastener means extending through a medial part of said tooth and into engagement with the holder for releasably affixing the tooth within the holder.

2. A combination excavating tooth and holder assembly for a trencher machine;

said holder having means forming a tooth-receiving pocket therein and means by which said holder can be attched respective to the trencher machine for excavating material;

said tooth is a truncated polygon which provides a frustum of a polygon, said polygon has oblique faces (48, 50) arranged to define parallel cutting edges (56, 58) at each marginal opposed end thereof which extend from and are parallel to said faces (48, 50);

said pocket receives one opposed marginal end of the tooth therewithin, with the cutting edge thereof residing within the pocket, means by which the configuration of the pocket is made complementary respective to the configuration of the marginal end of the tooth which is received therewithin so that the oblique face and sidewalls of one marginal end of the tooth engages the pocket sidewalls in close tolerance relationship;

said cutting edges of the tooth are provided with a layer of hard surfacing material which increases the thickness of the tooth, the cutting edges are arranged parallel to one another;

said pocket has an entrance defined by a forward end of the holder which terminates in a shoulder (44), said shoulder lies within a plane which is parallel to the opposed faces of the tooth; said pocket includes another inner wall (42) which is aligned parallel respective to each of said faces, and abuttingly engages the face of the tooth which is enclosed within said pocket;

said pocket includes at least one sidewall which slidably engages a side of the tooth in close tolerance relationship therewith.

3. In a digging machine of the type having an endless chain to which a plurality of tooth receiving holders are attached, with there being a digging tooth removably received within each holder, the improvement comprising:

said holder includes means forming a forwardly opening tooth-receiving pocket within a forward marginal end thereof, means by which said holder can be attached respective to a digging machine for excavating material;

said tooth is in the form of a frustum of a polygon, said polygon has oblique faces (48, 50) arranged in opposition to one another and means at each marginal end of each face which define cutting edges (56, 58) which extend from and are parallel to said faces (48, 50), said cutting edges of the tooth being provided with a layer of hard surfacing material which increases the thickness of the tooth, the cutting edges being arranged parallel to one another;

said pocket receives one of the opposed marginal ends of the tooth therewithin, with the cutting edge (58) of said one opposed marginal end residing within the pocket, means by which the configuration of the pocket is made complementary respective to the configuration of the marginal end of the tooth which is received therewithin so that one oblique face (58') and one sidewall (54) of the tooth engages the pocket sidewalls (42, 44) in close tolerance relationship;

said pocket has a entrance defined by a forward end of the holder which terminates in a shoulder (44), said shoulder lies within a plane which is parallel to the opposed faces (48,50) of the tooth; said pocket includes another inner wall (42) which is aligned parallel respective to the opposed ends of said tooth, and abuttingly engages the end (54) of the tooth which is enclosed within said pocket;

said polygon is a quadrilateral and the oblique faces are in the form of diamonds having apexes at the corners of the quadrilateral;

and fastener means for releasably holding the tooth in attached relationship within the pocket.

* * * * *

UNITED STATES PATENT AND TRADEMARK OFFICE

CERTIFICATE OF CORRECTION

PATENT NO. : 4,713,897

DATED : December 22, 1987

INVENTOR(S) : Charles W. Hemphill

It is certified that error appears in the above-identified patent and that said Letters Patent is hereby corrected as shown below:

Column 7, line 3, substitute --end-- for "and";

Line 10, substitute --of the-- for "ofthe".

Signed and Sealed this

Seventh Day of June, 1988

*Attest:*

DONALD J. QUIGG

*Attesting Officer*

*Commissioner of Patents and Trademarks*